United States Patent [19]

Peters et al.

[11] Patent Number: 4,831,909

[45] Date of Patent: May 23, 1989

[54] APPARATUS FOR SLITTING A WEB INTO NARROW WEBS OR STRIPS

[75] Inventors: Rudolf Peters; Richard Saatkamp, both of Lengerich, Fed. Rep. of Germany

[73] Assignee: Windmöller & Hölscher, Lengerich, Fed. Rep. of Germany

[21] Appl. No.: 113,814

[22] Filed: Oct. 28, 1987

[30] Foreign Application Priority Data

Nov. 5, 1986 [DE] Fed. Rep. of Germany ..... 3637608

[51] Int. Cl.[4] ..... B26D 5/06; B26D 7/26

[52] U.S. Cl. ..... 83/425.4; 83/433; 83/575; 83/858

[58] Field of Search ..... 83/425.4, 508.3, 563, 83/575, 675, 701, 433, 498–504, 858; 493/367, 475

[56] References Cited

U.S. PATENT DOCUMENTS 3,470,776 10/1969 Brichard et al. ..... 83/433
4,188,846 2/1980 Jones et al. ..... 83/499
4,516,454 5/1985 Mosburger ..... 83/425.4 X
4,604,934 8/1986 Elliott et al. ..... 83/425.4 X

FOREIGN PATENT DOCUMENTS 2306291 8/1974 Fed. Rep. of Germany .

*Primary Examiner*—Frank T. Yost
*Assistant Examiner*—Hien H. Phan
*Attorney, Agent, or Firm*—Fleit, Jacobson, Cohn & Price

[57] ABSTRACT

Apparatus for slitting a web (50) into narrower webs or strips comprises a plurality of cutters (45, 46), which are movable into engagement with the web to be slit and are carried by cutter holders (4), which are adjustable transversely to the web by positioning means (7). The cutter holders (4) are freely slidably mounted on a common track (2, 3) and are adapted to be fixed in position on said track by clamping or detent means (21, 22), which are adapted to be released by a control device (62). A feeder (7) is provided, which is parallel to the track (2, 3). The cutter holders (4) are adapted to be clamped or to be resiliently locked to said feeder under the control of a control device (62) so as to permit the cutter holders (4) to be displaced by the feeder to their desired positions.

5 Claims, 3 Drawing Sheets

APPARATUS FOR SLITTING A WEB INTO NARROW WEBS OR STRIPS

BACKGROUND OF THE INVENTION

1. FIELD OF THE INVENTION

This invention relates to an apparatus for slitting a web into narrower webs or strips, comprising a plurality of cutters, which are movable into engagement with the web to be slit and are carried by cutter holders, which are adjustable transversely to the web by positioning means.

2. DESCRIPTION OF RELATED ART

Published German Application No. 23 06 291 discloses an apparatus which is of the kind defined hereinbefore and serves to position tools serving for cutting and scoring corrugated cardboard for use in making cardboard boxes. In that apparatus the holders for the cutters or tools are moved to their desired positions by feed screws. That known apparatus is highly expensive because a separate feed screw is required for each toolholder.

SUMMARY OF THE INVENTION

It is an object of the invention to provide an apparatus which is of the kind described first hereinbefore and which is simpler in design so that it can be made more economically.

In an apparatus of the kind defined, that object is accomplished in accordance with the invention in that the cutter holders are freely slidably mounted on a common track and are adapted to be fixed in position on said track by clamping or detent means, which are adapted to be released by a control device, a feeder is provided, which is parallel to the track, and the cutter holders are adapted to be clamped or to be resiliently locked to said feeder under the control of a control device so as to permit the cutter holders to be displaced by the feeder to their desired positions.

The apparatus in accordance with the invention differs from the known apparatus by having a common track for all cutter holders so that the structural expenditure is substantially reduced. The apparatus in accordance with the invention is simplified further in that the cutter holders are adapted to be coupled to a single feeder for moving all cutter holders to their respective desired positions. If it is desired to adapt the apparatus to new product sizes, it will be sufficient to displace the individual cutter holders from a stand-by position on one side of the track to their desired positions. Similarly, the cutter holders can be moved from their desired positions to their stand-by positions on one side of the track.

The apparatus according to the invention may be used to slit webs of paper, plastic or the like, which are trained around guide rollers.

An automation of the size adjustment will be permitted by the provision of a length-measuring system, which extends parallel to the track and serves to detect the actual position of each cutter holder. The length-measuring system will indicate to a comparator the actual position of the cutter holder which is to be moved to its desired position. In the comparator, a comparison with the stored desired value is effected and the cutter holder is then clamped to the track when the desired position has been reached.

The non-contacting measuring system suitably comprises an ultrasonic displacement pick-up comprising a magnetostrictive rod, which is parallel to the track and which for a generation of an actual value signal is hugged by a magnet, which is connected to the cutter holder. In such an ultrasonic displacement pick-up of Philips (UWS-1), the transit time of an ultrasonic pulse is used as a measured value. An ultrasonic pulse is generated at the point of measurement as a result of the "magnetostrictive effect". The interference of the two magnetic fields having different directions (the magnetic field associated with the cutter holder provided with the magnet and the magnetic field which is due to the transmitted pulse) results in a resultant magnetic field, which changes the length of the magnetostrictive wire or rod so that an ultrasonic pulse is generated in the magnetostrictive rod. The transit time of that pulse is measured and in the processing electronic system is processed to produce a digital or analog actual displacement signal. The measurement can be performed with a resolution of about 0.1 mm. It is apparent that the displacement pick-up effects a measurement of the transit time of an ultrasonic pulse between two points, one of which is fixed whereas the other is defined by an ultrasonic receiver.

The track for the cutter holders suitably consists of two parallel tubes, on which each cutter holder is guided by slide bushings.

The feeder may consist of an endless belt, which is provided with drive means and has a course which is parallel to the track and to which the cutter holders are adapted to be clamped. The clamping device may consist of a plurality of brake levers, which are pivoted to respective cutter holders and are adapted to be spring-urged against the track and to be disengaged by an actuator. The actuator suitably consists of a push rod for raising the lever.

The magnet of the ultrasonic displacement pick-up is suitably connected to the push rod in such a manner that the magnet will hug the magnetostrictive rod when the brake is lifted.

In accordance with a further feature of the invention a trailing flexible compressed air line is connected to each cutter holder and the means for actuating the push rod consist of a pneumatic cylinder. The means for coupling the cutter holders to the feeder may comprise a brake shoe, which is operable by a pneumatic cylinder to force the feeding course of the belt against an abutment plate of the cutter holder. In order to synchronize the lifting of the brake, the hugging of the magnetostrictive rod by the magnet, and the clamping of the cutter holder to the feeding course of the belt, the compressed air lines leading to the pneumatic cylinders which are connected to the push rod and the brake shoe may communicate with each other.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF THE PREFERRED EMBODIMENT

Figure 1:
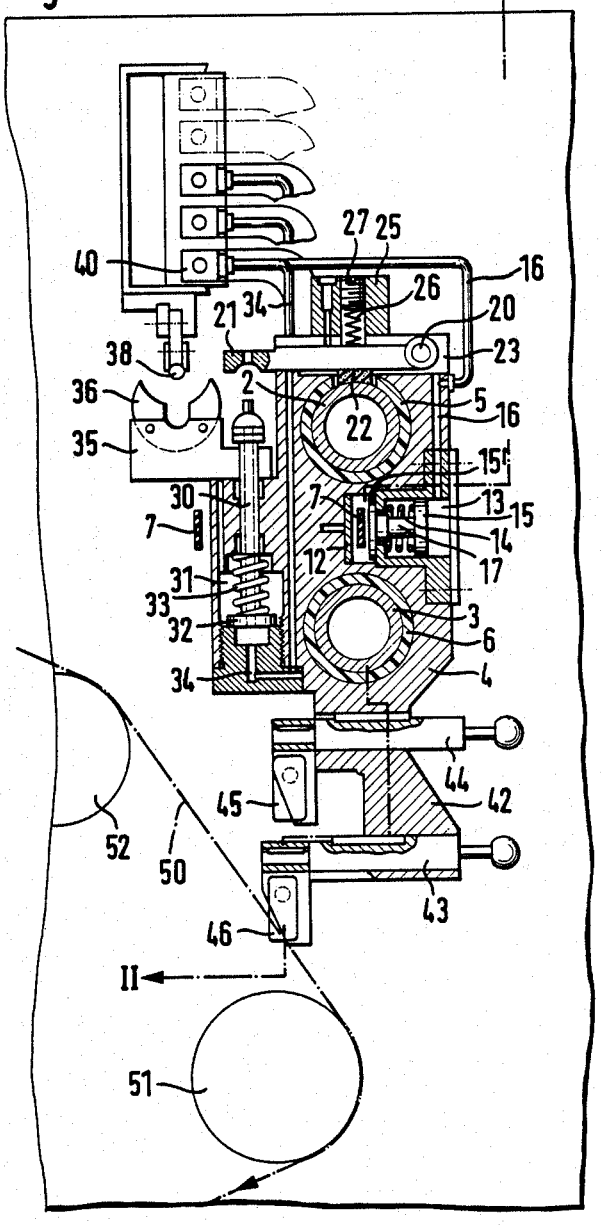
FIG. 1 is a transverse sectional view showing the apparatus for slitting a web into narrower webs or strips.

An illustrative embodiment of the invention will now be explained more in detail with reference to the drawing.

Figure 2:
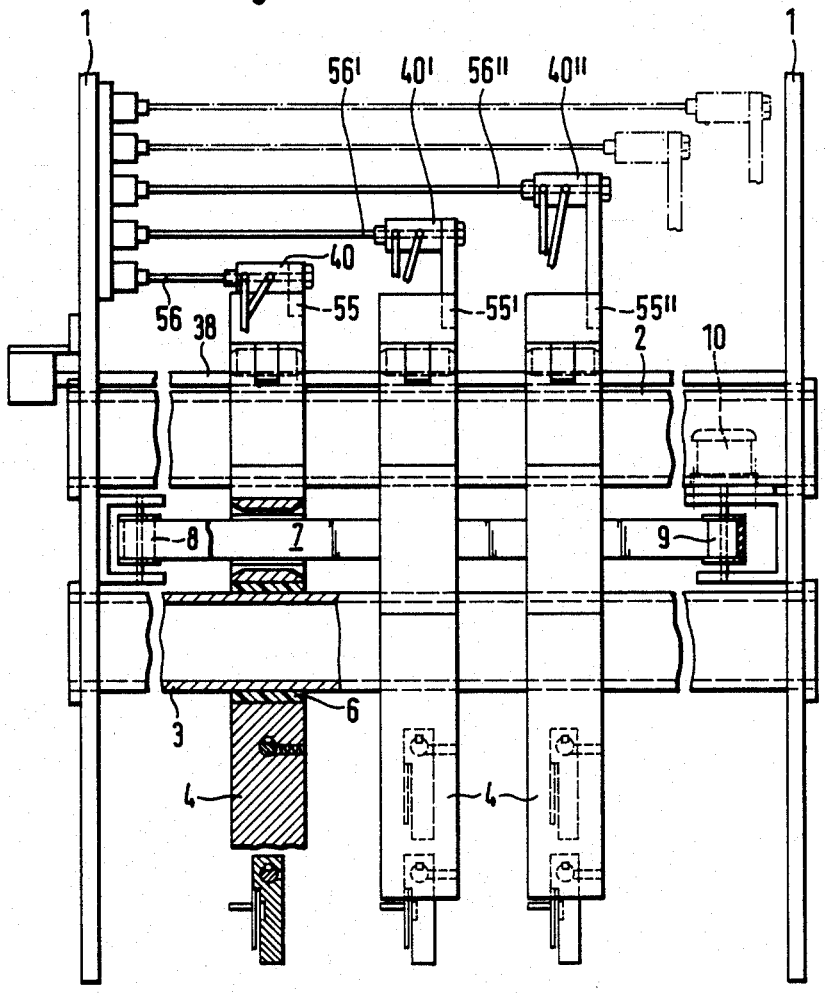
FIG. 2 is a front elevational partly in a section taken on line 11—11 in FIG. 1.

Spaced apart parallel track tubes 2, 3 are secured to the side portions of the machine frame 1. Cutter holders 4 are slidably mounted on said track tubes 2, 3 and are provided with slide bushings 5, 6, which fit around the track tubes 2, 3. Only three cutter holders 4 are shown in FIG. 2. An endless conveyor belt 7 is disposed between the track tubes 2, 3 and is trained around pulleys 8,9, which are mounted in the side parts of the machine frame for rotation about vertical axes. The pulley 9 is driven pulley having a shaft driven by the electric motor 10.

As is apparent from FIGS. 1 and 2, the feeding course of the conveyor belt 7 extends through a recess formed in the guide block of the cutter holder 4. The bottom of that groovelike recess is constituted by an abutment plate 12. The groove is closed by the pneumatic cylinder 13, which contains a piston 15 that is biased by a spring 14. In response to pressure applied to the piston 15 through the compressed air line 16 the piston rod 17 is extended and with its end face which constitutes a brake shoe forces the feeding course of the conveyor belt 7 against the abutment plate 12 so as to couple the cutter holder 4 to the conveyor belt. When the pneumatic cylinder 13 is relieved from pressure, the compressive spring 14 urges the piston 15 to its retracted position, in which the feeding course of the conveyor belt 7 extends through the recess between the abutment plate 12 and the pneumatic cylinder 13 without contacting said parts.

In a groovelike recess at the upper end of the guide block of the cutter holder, the brake lever 21 is pivoted on a pivot 20. The brake lever 21 is provided on its underside with a brake lining 22, which has a curved hollow-cylindrical surface. Adjacent to the track tube 2 the brake lining 22 extends thorough the bottom of the groove 23 so that the brake lining can directly engage the upper portion of the peripheral surface of the track tube 2. The slide bushing 5 is formed with a corresponding recess, through which the brake lining 22 can be inserted.

A top member 25 is screw-connected to the guide block of each cutter holder 4 and has a through bore, which contains a compression spring 26, which biases the brake lever 21. The compression spring 26 bears at one end of the brake lever 21 and at the other end on a screw 27, which closes the bore and which can be used to adjust the compressive stress of the spring.

A push rod 30 for lifting the brake lever 21 is axially slidably mounted in the guide block of the cutter holder 4 and virtually constitutes an extension of the piston rod of the pneumatic cylinder 31. A compression spring 33 is disposed between the forward end of the cylinder and the piston 32 and urges the piston 32 to its retracted position. A compressed air line 34 is connected to the pneumatic cylinder. In response to a supply of compressed air to the pneumatic cylinder 31, the push rod 30 is extended to raise the brake lever 21 so that the brake lining 22 is lifted from the track tube 2.

By means of a bracket 35, an electromagnet 36 is connected to the upper portion of the push rod 30 and as the push rod 30 is extended that electromagnet 36 is raised to hug the magnetostrictive rod 38, which is parallel to the tracks.

The compressed air lines 16, 34 are connected to a manifold 40, which is connected to a flexible compressed air supplyline. The guide block of each cutter holder 4 is provided at its lower end with an extension 42, which is formed with parallel guide bores, which extend in a vertical plane and serve to guide the rods 43, 44. The cutters 45, 46 are secured to the forward ends of said rods. The cutter blades are inserted into a recess of retaining members. The magnets for retaining the cutters are disposed at the bottom of said recess. Spring plates lie on the cutter blades so that the cutter blades are non-positively retained by the magnet and are positively held against rotation. A rotation of the rods 43, 44 in the associated bores is prevented by splines. The rods 43, 44 can be advanced and retracted to move one cutter to its cutting and retracted positions are defined by spring-loaded balls snapping into corresponding detent openings.

The web 50 to be slit moves over guide rollers 51, 52. The direction of travel of the web is indicated by an arrow.

As is best apparent from FIG. 2, the manifolds are connected to the cutter holders by means of vertically spaced apart brackets 55, 55', 55''. The manifolds are connected to respective flexible compressed air hoses 56, 56', 56'', which are wound on and can be withdrawn from spring-loaded hose drums, which are mounted in the machine frame. As a result, the fluid hoses emerging from the guide bores of the machine frame are taut between the machine frame and the manifolds.

Figure 3:
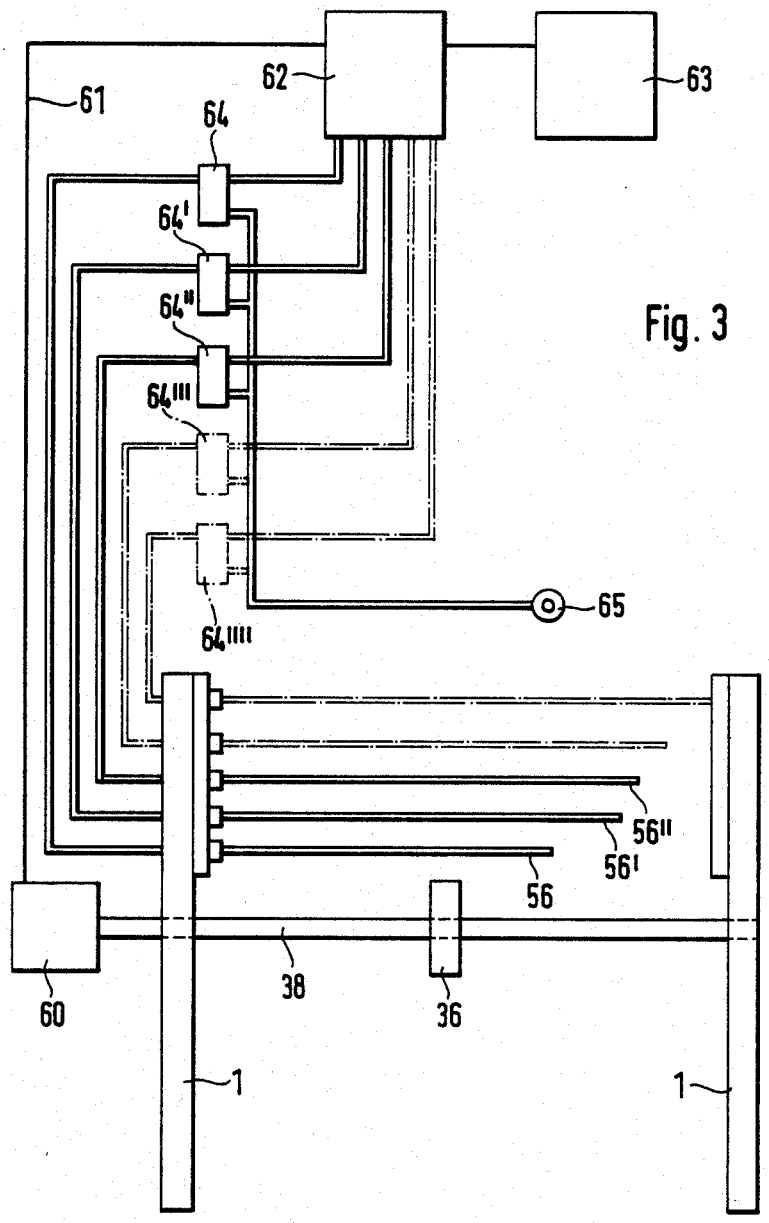
FIG. 3 is a diagram illustrating the control and automatic control means and the pneumatic lines.

As is apparent from the diagrammatic FIG. 3, an actual-value pick-up 60 is connected to the magnetostrictive rod 38 and includes also the ultrasonic pulse generator of the ultrasonic displacement pick-up. The actual-value signals generated in dependence on the position of the respective magnets are delivered via line 61 to the comparator 62 for comparing the desired and actual values. Set point signals are delivered to said comparator by the set point generator 63. The controller which includes the comparator 62 controls the solenoid-actuated pneumatic valves 64 to 64'''', which are supplied with compressed air from the compressed air source 65.

It will be evident that when a holder is to be moved from one position to another along the tubes 2 and 3, the brake 22 must be released and piston 17 must be actuated to clamp against the conveyor belt 7. These operations are effected pneumatically by opening a respective one of valves 64 to 64'''', for example, by a signal received from the controller. Then, motor 10 is actuated, which may also be done by the controller, to operate belt 7 and move the respective holder along the tubes. When the holder has been moved to the required position, as determined by the ultrasonic measuring system, the controller may likewise be used to deactivate motor 10, and release pressure from the pneumatic cylinders respectively operating piston 17 and push rod 30. As previously indicated, the ultrasonic measuring system may itself be of a type which is known per se.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An apparatus for slitting a web into narrower webs or strips, comprising:

a plurality of cutters, which are movable into engagement with the web, cutter holders carrying said cutters, positioning means for adjusting said cutter holders transversely relative to the web, a common track on which the cutter holders are freely slidably mounted, clamping means for fixing said cutter holders in position on said track said clamping means comprising a brake lever pivoted to each of said cutter holders and spring urged against said common track, a push rod for disengaging each said brake lever from said track, a pneumatic cylinder for actuating said push rod, a control device adapted to release said clamping means, a feeder provided parallel to the track, the cutter holders adapted to be clamped to said feeder, the control device controlling clamping of said cutter holders to said feeder so as to permit the cutter holders to be displaced by the feeder to their desired positions, a length-measuring system, extending parallel to the common track serving to detect the actual position of each cutter holder, the length-measuring system being a non-contacting measuring apparatus comprising an ultrasonic displacement pick-up comprising a magnetostrictive rod, which is parallel to the track and a magnet, hugging said magnetostrictive rod for generation of an actual value signal, connected to each cutter holder, said magnet being connected to said push rod so that said magnet will hug said magnetostrictive rod when said brake lever is disengaged, and a trailing flexible compressed air line connected to each cutter holder.

2. An apparatus according to claim 1, characterized in that the track comprises two parallel tubes, on which each cutter holder is guided by slide bushings.

3. An apparatus according to claim 1, characterized in that the feeder comprises of an endless belt, which is provided with drive means and has a course which is parallel to the track and to which the cutter holders are adapted to be clamped.

4. An apparatus according to claim 3, characterized in that the belt is adapted to be forced against an abutment plate of the cutter holder by a brake shoe, which is operated by a pneumatic cylinder.

5. An apparatus according to claim 4, characterized in that compressed air lines connected to the pneumatic cylinders associated with the push rod and the brake shoe communicate with each other.

* * * * *